US005416958A

United States Patent [19]

Lilly et al.

[11] Patent Number: 5,416,958

[45] Date of Patent: May 23, 1995

[54] EASY NAP TEXTILE FABRIC AND PROCESS FOR MAKING

[75] Inventors: Robert L. Lilly, Asheville; Pravin Asher, Candler, both of N.C.

[73] Assignee: BASF Corporation, Parsippany, N.J.

[21] Appl. No.: 823,481

[22] Filed: Jan. 21, 1992

[51] Int. Cl.[6] ..... D06C 11/00

[52] U.S. Cl. ..... 26/29 R; 28/162; 428/85

[58] Field of Search ..... 26/29 R, 30, 31, 33; 28/162

[56] References Cited

U.S. PATENT DOCUMENTS

| | | | |
|---|---|---|---|
| 3,650,800 | 3/1972 | Reiner | 26/29 R |
| 3,808,302 | 4/1974 | Dyer et al. | 264/211 |
| 3,847,544 | 11/1974 | Quynn | 28/169 |
| 3,865,678 | 2/1975 | Okamoto et al. | 28/162 |
| 4,003,974 | 1/1977 | Chantry et al. | 264/210 F |
| 4,004,878 | 1/1977 | Magosch et al. | 8/115.5 |
| 4,008,344 | 2/1977 | Okamoto et al. | 28/155 |
| 4,153,660 | 5/1979 | Reese | 28/220 |
| 4,316,928 | 2/1982 | Otto | 26/28 |
| 4,390,566 | 6/1983 | Umezawa et al. | 26/29 R |
| 4,497,095 | 2/1985 | Minemura et al. | 26/2 R |
| 4,743,483 | 5/1988 | Shimizu et al. | 26/2 R |
| 4,970,038 | 11/1990 | Stanko | 264/130 |
| 5,102,724 | 4/1992 | Okawahara et al. | 26/18.5 |

FOREIGN PATENT DOCUMENTS

| | | |
|---|---|---|
| 58-104217 | 6/1983 | Japan . |
| 61-194211 | 8/1986 | Japan . |
| 61-194212 | 8/1986 | Japan . |

OTHER PUBLICATIONS

Davis, G. W., Everage, A. E., Talbot, J. R. Polyester Fibers: High Speed Melt Spinning, *Fiber Producer*, Feb. 1984, pp. 22–28.

"How Nappers Work—And How to Work Them", Gessner Co. Textile World, Jul. 1958, McGraw-Hill Publishing Co., Inc.

"A New Face for Knit Goods", by Leon E. Seidel, Textile Industries, May 1978.

"Yesterday's Finishing Techniques as Applied to Today's Fabrics", by Richard A. Herard, AATCC Book of Papers, 1978 National Conference.

*Primary Examiner*—Clifford D. Crowder
*Assistant Examiner*—Amy B. Vanatta

[57] ABSTRACT

A napped textile product is prepared by supplying a polyethylene terephthalate homopolymer yarn having an elongation of from about 20% to about 80%, a tenacity of from about 2.5 to about 3.5 grams/denier, and a boiling water shrinkage of from about 2% to about 15%; (b) forming a fabric from the yarn, so that substantially all yarn is the polyester yarn supplied in step (a); and (c) providing the fabric prepared in step (b) to a napping machine.

6 Claims, 2 Drawing Sheets

As-spun fiber boiling water shrinkage vs spinning speed

As–spun fiber boiling water shrinkage vs spinning speed

As–spun fiber tenacity and elongation vs spinning speed

EASY NAP TEXTILE FABRIC AND PROCESS FOR MAKING

FIELD OF THE INVENTION

This invention relates generally to napped textile fabrics. More particularly, the present invention relates to textile fabrics which are easily napped due to the yarn used in preparing the fabrics and a process for preparing these fabrics.

BACKGROUND OF THE INVENTION

A good quality napped fabric is one where yarns in the fabric are evenly napped. To assist in napping, it is desirable to provide face yarns which are easily napped. Easily napped fibers allow greater control of the degree of napping and are cost efficient. Therefore, yarns destined for napping should have physical properties suited to napping. Where yarns require more than one pass through the napping machine to prepare a good quality napped fabric, the cost of producing the napped fabric increases for each pass through the napping machine.

One way of making a yarn which is easily napped is by decreasing the tensile strength of the yarn fibers. Known methods for decreasing yarn strengths include the addition of additives to a polymer, for example, to form a copolymer which reduces the molecular weight of the polymer to correspondingly reduce intrinsic viscosity with concomitant decrease in the tensile strength of the thread. The use of such relatively low intrinsic viscosity (IV) polyesters is known to be advantageous for certain applications. For example, U.S. Pat. No. 3,808,302 to Dyer et al. discloses a method of reducing pilling in polyester fabrics by reducing the intrinsic viscosity of the fabric. The resultant fiber has an ultimate tenacity of about 2.6 to 3.2 grams per denier and elongation of about 25 to 40 percent. The lowered strength due to the lowered intrinsic viscosity helps to prevent the formation of pills.

In addition, it is known to chemically weaken polyester fibers, as well as fabrics manufactured from them, by treating the fiber or fabric with a weakening agent. For example, U.S. Pat. No. 4,004,878 to Magosch et al. describes treating polyester threads with aqueous acid to reduce their strength and, in turn, reduce pilling.

It is known also to tailor polyester products to certain end uses, including napped fabrics. Japanese Kokai Patent Application No. 58-104217 describes a multifilament poly(tetramethylene terephthalate) of 0.3 to 0.9 denier and various other properties for ultrafine applications. This fiber is useful in making tricot and tricot raised commodities (napping). The Kokai describes ultrafine polyethylene terephthalate fibers as not having all the desired physical properties required for tricot.

Japanese Kokai Patent Application No. 61-194211 describes a poly(ethylene terephthalate) product which is drawn at 160° C. and 5000 mpm to give fibers having 60% elongation, tensile strength of 1.4 g/denier and boiling water shrinkage of 3.5%. The yarn is used at relatively high speeds in a water jet loom without gripper breakage or reed wear.

Japanese Kokai Patent Application No. 61-194212 describes a polyethylene terephthalate yarn having an elongation of up to 80%, tensile strength of about 1.4 g/denier and boiling water shrinkage less than 5%. The yarn is prepared at high speeds (4000–8000 mpm) for use in linings, etc.

U.S. Pat. No. 4,970,038 to Stanko describes a process for making moderate tenacity polyester (about 4.5–7.0) with boiling water shrinkage of about 2% to 10%.

Relatively high speed processes for preparing polyethylene terephthalate yarns are known. In addition to high speed processes mentioned above, U.S. Pat. No. 4,003,974 to Chantry et al. describes a high speed process for preparing a high tenacity (7.5 to 9 grams per denier), low elongation (12 to 20 percent) fiber. These yarns have a dry heat shrinkage of 4 percent or less. The patent describes wind-up speeds of 2,000 yards per minute and higher.

Yet, there remains a need for polyethylene terephthalate yarns which are suitable for fabrication into fabrics and are still easily napped.

SUMMARY OF THE INVENTION

Accordingly, the present invention provides a process for preparing napped textile products by (a) supplying a polyethylene terephthalate homopolymer yarn having an elongation of from about 20% to about 80%, a tenacity of from about 2.5 to about 3.5 grams/denier, and a boiling water shrinkage of from about 2% to about 15% (b) forming a fabric from the yarn, so that substantially all yarn is the polyester yarn supplied in step (a); and (c) providing the fabric prepared in step (b) to a napping machine.

Also, the present invention provides a napped textile fabric.

It is an object of this invention to provide an improved fabric for napping.

It is another object of this invention to provide an improved process for making napped fabric.

After reading the following description, related objects and advantages of the present invention will be apparent to those ordinarily skilled in the art to which the invention pertains.

DETAILED DESCRIPTION OF THE PREFERRED EMBODIMENTS

To promote an understanding of the principles of the present invention, descriptions of specific embodiments of the invention follow and specific language describes the same. It will nevertheless be understood that no limitation of the scope of the invention is thereby intended, and that such alterations and further modifications, and such further applications of the principles of the invention as discussed are contemplated as would normally occur to one ordinarily skilled in the art to which the invention pertains.

Figure 1:
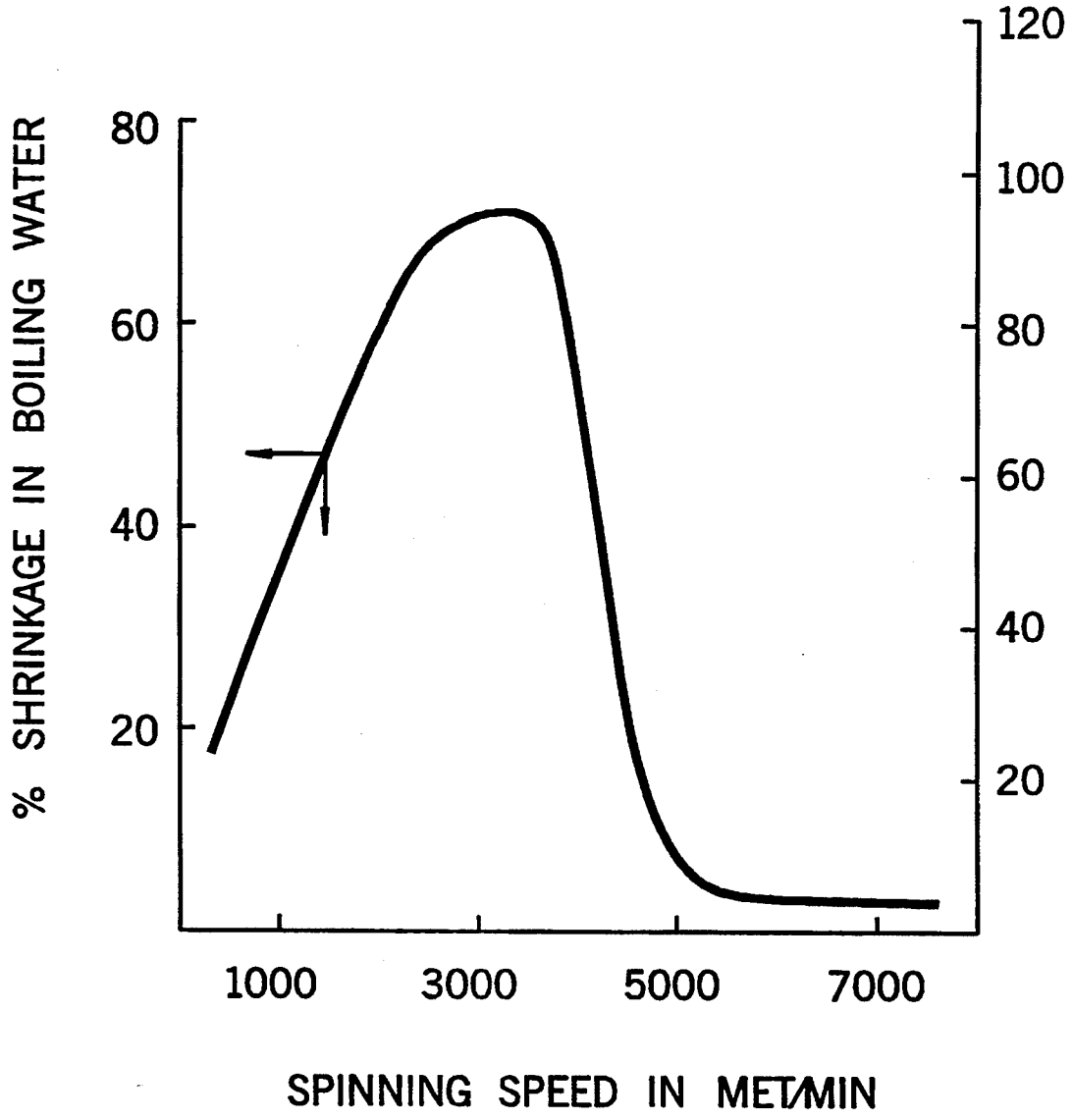
FIG. 1 is a graph illustrating the relationship of shrinkage to winding speed.
Figure 2:
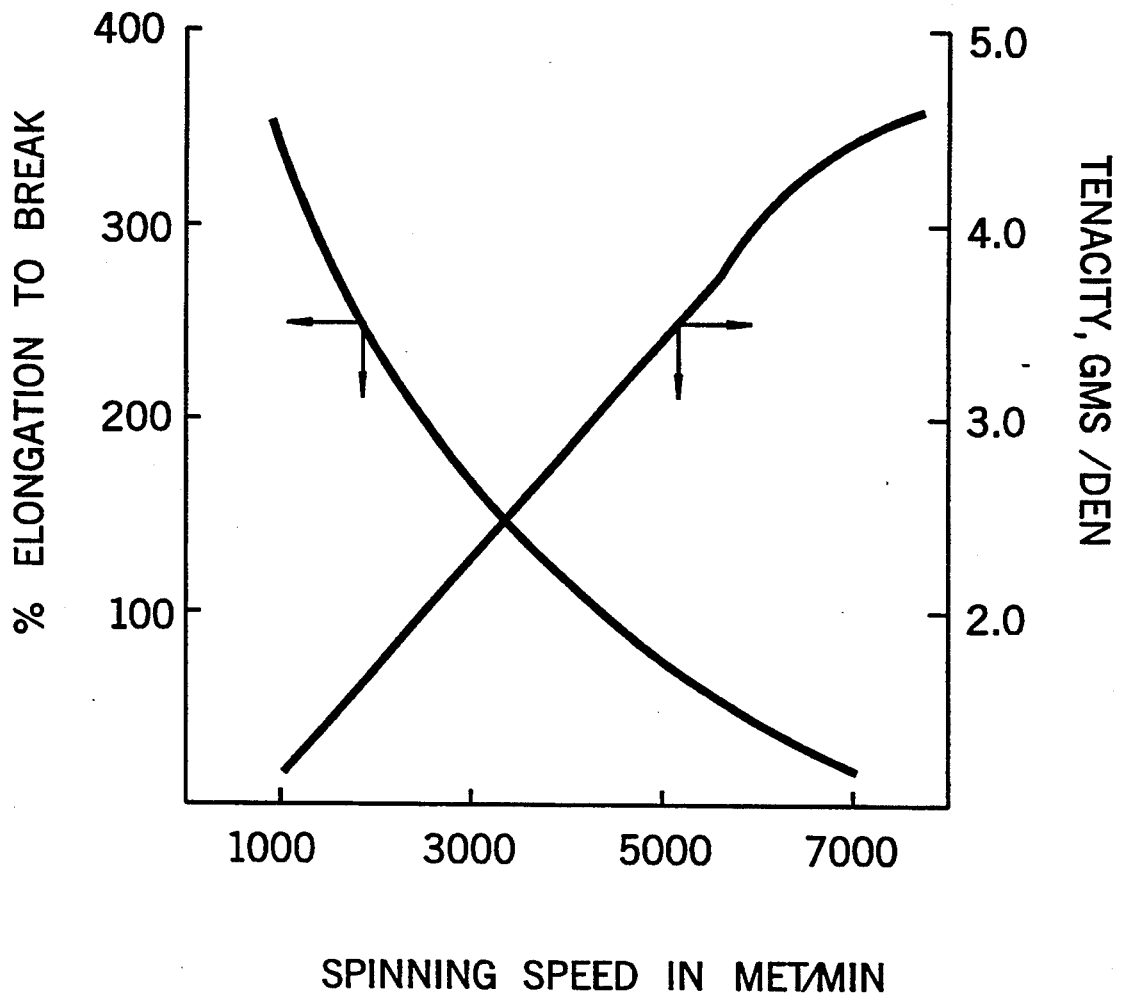
FIG. 2 is a graph illustrating the relationship of tenacity and elongation to winding speed.

A first embodiment of the present invention involves a process for preparing a napped textile product. The process includes supplying a polyethylene terephthalate homopolymer yarn. The polyethylene terephthalate homopolymer may be prepared by any one of the known methods for preparing such homopolymer and spun according to conventional polyethylene terephthalate homopolymer spinning techniques. After extrusion, a one-step process may be used to prepare a polyethylene terephthalate homopolymer yarn within predetermined limits of elongation, tenacity and boiling water shrinkage. When the one-step process is used, the yarn is conventional one-step yarn which may be partially oriented (POY), fully oriented (FOY) or highly oriented (HOY). The desired shrinkage, elongation and tenacity may be accomplished with controlled winding speed. The effect of winding speed on shrinkage, tenacity and elongation is illustrated in FIG. 1–FIG. 2. These speed on shrinkage, tenacity and elongation is illustrated in FIG. 1–FIG. 2. These FIGS. were adopted from Davis, G. W., Everage, A. E., Talbot, J. R., Polyester Fibers: High Speed Melt Spinning, FIBER PRODUCER, Feb. 1984, pp. 22–28.

The boiling water shrinkage, tenacity and elongation of the yarn are made within predetermined limits by setting the take-up speed of the yarn at at least 3,000 meters per minute. Depending on the exact properties desired, heat may be used during winding. For example, at 3000 m/min at 296 ° C., yarn having 3.6 grams per denier tenacity, 5.2% shrinkage, and 44.1% elongation as described in Example 1 can be produced. Yarn produced at these high speeds will have an elongation of from about 20% to about 80%; a tenacity of from about 2.5 to about 3.5 grams per denier; and a boiling water shrinkage of from about 2 percent to about 15 percent. More preferably, the elongation will be about 55%; tenacity about 3.0 grams per denier; and boiling water shrinkage about 3.0%.

Following preparation of the yarn, it is used to form a fabric. The forming of a fabric may be according to any known process including warp knitting and weaving. Following forming, the fabric is sent to a napping machine, where it is napped according to conventional processes for the desired result. For example, if velour fabric is desired, then a velour process is used. Descriptions of various napping techniques are contained in "How NAPPERS Work—And How To Work Them", Gessner Co., TEXTILE WORLD, July 1958, McGraw-Hill Publishing Co., Inc.; "A New Face for Knit Goods", by Leon E. Seidel, TEXTILE INDUSTRIES, May 1978; and "Yesterday's Finishing Techniques as Applied to Today's Fabrics", by Richard A. Herard, AATCC Book of Papers, 1978 National Conference.

Another embodiment of the present invention is a napped textile fabric. This fabric has yarn of primarily polyethylene terephthalate homopolymer. The homopolymer has an elongation of from about 20% to about 80%, a tenacity of from about 2.5 to about 3.5 grams per denier, and a boiling water shrinkage of from about 2% to about 15%. This fabric is preferably prepared according to the process of the present invention and is generally napped to the desired level of napping with a single pass through a known napping machine. This is true, surprisingly, even when a highly napped fabric is desired. A single pass through the napping machine with the fabric of the present invention is sufficient. This is contrary to previously known fabrics which, as a rule, required multiple passes through the napper.

The invention will be described by reference to the following detailed examples. The Examples are set forth by way of illustration, and are not intended to limit the scope of the invention. In the examples, all parts are part by weight unless otherwise specified.

EXAMPLE 1

Yarn Produced at 3,000 mpm

Polyester terephthalate chips approximately 0.65 I.V. are extruded through a spinneret assembly at a temperature of 296° C. through a spinning zone to a set of ambient temperature draw off godets controlled at a surface speed of 3,000 mpm and onto a flat package take-up. In the spinning zone, the extruded filaments are passed through a quench chamber for solidification below the glass transition temperature. The yarn is then heat treated at a temperature of 180° C.. Spin finish is applied to the yarn, which is subsequently air entangled and wound at 3,000 mpm.

The physical properties of the above yarn are shown in Table I for 60/32 SB (3000 mpm).

EXAMPLE 2

Yarn Produced at 5,000 mpm

Polyester terephthalate chips of approximately 0.65 I.V. are extruded through a spinneret assembly at a temperature of 296° through a spinning zone to a set of ambient temperature draw off godets controlled at a surface speed of 5,000 mpm and on to a flat package take-up. In the spinning zone, the extruded filaments are passed through a quench chamber for solidification below the glass transition temperature, then spin finish is applied when the yarn is just below the glass transition temperature. The filaments are air entangled between the take-up godets and wound at 5,000 mpm winding speed.

The physical properties of the above yarn are shown in Table I for 60/32 SB (5000 mpm).

EXAMPLE 3

Comparative Example

A conventional yarn is prepared from polyethylene terephthalate chips of approximately 0.65 I.V. through a spinneret assembly at a temperature of 292° C. The extruded filaments are passed through a quench zone for solidification below the glass transition temperature, then spin finish is applied using a metered finish applicator located 1.2–1.4 meters from spinnerets. The filaments are air entangled between the take-up godets, and wound at 165 1 mpm winding speed. The yarn is then drawn on a conventional drawtwister.

The physical properties of the above yarn are shown in Table I for 50/32 BRT MCS.

TABLE I

Physical Properties of Yarn
Spun/Wound at 3,000 and 5,000 mpm vs. Control

| | 60/32 SB MCS (3000 mpm) | 50/32 BRT MCS 1651 mpm winding speed + draw ratio | 60/32 SB (5000 mpm) |
|---|---|---|---|
| Denier | 62.0 | 52.1 | 60.7 |
| Tensile Properites | | | |
| Tenacity, gpd | 3.6 | 4.6 | 3.0 |
| Elongation, % | 44.1 | 20.4 | 55.0 |
| Breaking Strength, g | 223.6 | 237.4 | 186.8 |
| Work-to-Break, g | 79.6 | 38.6 | 69.4 |
| Toughness, gpd | 1.3 | 0.74 | 1.0 |
| Modulus, at 1% Elongation, gpd | 70.2 | 77.2 | 54.9 |
| Uster II Unevenness | | | |
| % CV | 1.2 | 1.4 | 0.85 |
| % Unevenness | 5.3 | 6.0 | 3.6 |
| Boiling Water Shrinkage, % | 5.2 | 7.9 | 3.0 |
| Entanglements/meter (water pan) | 23 | 49 | 20 |
| Modification Ratio | 1.52 | 1.77 | 1.66 |
| Extractable Finish, % (Petroleum Ether) | 1.0 | 1.0 | 0.9 |
| Yarn I.V. | 0.60 | 0.62 | 0.63 |

TABLE I-continued

Physical Properties of Yarn
Spun/Wound at 3,000 and 5,000 mpm vs. Control

| | 60/32 SB MCS (3000 mpm) | 50/32 BRT MCS 1651 mpm winding speed + draw ratio | 60/32 SB (5000 mpm) |
|---|---|---|---|
| Dynafil Draw Force, cN (Shrinkage Force) | 1.839 | 0.969 | 4.905 |
| Sonic Modulus, gpd | 101.8 | 107.9 | 77.5 |
| Density, g/cc | 1.3798 | 1.3838 | 1.3859 |
| Crystallinity, % | 33.6 | 36.7 | 38.2 |
| Crystalline size, A | | | |
| $\bar{1}05$ | 55.2 | 58.7 | 81.4 |
| Crystalline Perfection Index | | | |
| Å CPI | 2.47 | 1.89 | 4.21 |
| $\bar{1}05$ | −0.31 | 0.11 | 0.63 |

EXAMPLE 4

The yarns described in Examples 1, 2 and 3 were warped and knitted under identical warp knitting conditions prior to napping operations. Fabrics produced from the yarns were napped on a Gessner double acting napper using a ruby or velvet-like finishing setup. The fabrics were first pre-heatset at 360° F., beam dyed, then dried at 300° F. The fabrics were then passed through double acting nappers in tandem and sheared. The fabrics were checked after each pass through the nappets for broken filaments and surface appearance. The sample fabric described in Example 2 had surface appearance with sufficient broken filaments to give a ruby or velvet-like appearance after passing over three nappers in tandem. The sample fabric described in Example 1 had the second best appearance after passing through four nappers. The control fabric described in Example 3 had the least desirable appearance and required passing through five nappers in tandem.

Although this conventional yarn has desirable yarn shrinkage, the high tenacity and low elongation yarn requires more passes during napping than is required for the yarn of Examples 1 and 2.

What is claimed is:

1. A process for preparing napped textile products comprising:

(a) supplying an interlaced, untreated polyethylene terephthalate homopolymer yarn having an elongation of from about 20% to about 80%, a tenacity of from about 2.5 to about 3.5 grams/denier, and a boiling water shrinkage of from about to about 15%;

(b) forming a fabric from the yarn, so that substantially all yarn is the polyester yarn supplied in step (a);

(c) providing the fabric prepared in step (b) to a napping machine; and (d) napping the provided fabric in the napping machine such that the fabric is sufficiently napped after a single pass through the napping machine.

2. The process of claim 1 wherein said forming is by warp knitting.

3. The process of claim 1 wherein said forming is by weaving.

4. A process for preparing a napped textile product comprising:

(a) supplying an interlaced, untreated polyethylene terephthalate homopolymer yarn prepared at a winding speed greater than about 3000 mpm;

(b) forming a fabric from the yarn, so that substantially all yarn is the polyester yarn supplied in step (a);

(c) providing the fabric prepared in step (b) to a napping machine; and (d) napping the provided fabric in the napping machine such that the fabric is sufficiently napped after a single pass through the napping machine.

5. The process of claim 4 wherein said forming is by warp knitting.

6. The process of claim 4 wherein said forming is by weaving.

* * * * *

UNITED STATES PATENT AND TRADEMARK OFFICE

CERTIFICATE OF CORRECTION

PATENT NO. : 5,416,958

DATED : May 23, 1995

INVENTOR(S) : Robert L. Lilly; Pravin Asher

It is certified that error appears in the above-identified patent and that said Letters Patent is hereby corrected as shown below:

At column 5, line 30, please delete "nappets" and insert --nappers-- in its place.

At column 6, line 10, please insert --2%-- after the first occurrence of "about".

Signed and Sealed this

Seventh Day of November, 1995

Bruce Lehman

*Attest:*

BRUCE LEHMAN

*Attesting Officer*

*Commissioner of Patents and Trademarks*